US008307615B2

(12) United States Patent
Gonzalez et al.

(10) Patent No.: US 8,307,615 B2
(45) Date of Patent: Nov. 13, 2012

(54) QUICK-CHANGE TOOLING SYSTEM

(75) Inventors: Leoncio Angel Gonzalez, Winfield, IL (US); Mitar Vojcic, Morton Grove, IL (US)

(73) Assignee: Sunstar Americas, Inc., Chicago, IL (US)

( * ) Notice: Subject to any disclaimer, the term of this patent is extended or adjusted under 35 U.S.C. 154(b) by 365 days.

(21) Appl. No.: 12/670,926

(22) PCT Filed: Jul. 25, 2008

(86) PCT No.: PCT/US2008/071221

§ 371 (c)(1),
(2), (4) Date: Jan. 27, 2010

(87) PCT Pub. No.: WO2009/018160

PCT Pub. Date: Feb. 5, 2009

(65) Prior Publication Data

US 2010/0251666 A1 Oct. 7, 2010

Related U.S. Application Data

(60) Provisional application No. 60/952,485, filed on Jul. 27, 2007.

(51) Int. Cl.
*B65B 59/04* (2006.01)

(52) U.S. Cl. ..... 53/456; 53/566

(58) Field of Classification Search ..... 53/456, 53/458, 566; 493/313, 317; 414/737, 736, 414/752, 744.1, 744.2, 744.3; 221/211, 224
See application file for complete search history.

(56) References Cited

U.S. PATENT DOCUMENTS

| | | | | |
|---|---|---|---|---|
| 3,928,942 | A * | 12/1975 | Paddock et al. | 53/247 |
| 4,386,693 | A | 6/1983 | Bachman | |
| 4,712,818 | A | 12/1987 | Borgman et al. | |
| 5,222,854 | A * | 6/1993 | Blatt et al. | 198/463.3 |
| 5,632,588 | A * | 5/1997 | Crorey et al. | 198/468.2 |
| 5,680,746 | A * | 10/1997 | Hornisch | 53/475 |
| 7,779,716 | B2 * | 8/2010 | Dellach et al. | 74/490.02 |
| 2003/0046904 | A1 | 3/2003 | Goodman | |
| 2009/0297316 | A1 * | 12/2009 | Wells et al. | 414/737 |

OTHER PUBLICATIONS

Declaration of Leoncio Angel Gonzalez dated Jan. 14, 2011 (7 pages).

International Search Report and Written Opinion of the International Searching Authority, International Patent Application No. PCT/US2008/071221, mailed Jun. 1, 2011.

* cited by examiner

*Primary Examiner* — Hemant M Desai

(74) *Attorney, Agent, or Firm* — Michael Best & Friedrich LLP

(57) ABSTRACT

A quick-change tooling system includes a plurality of pickers each configured to pick specific items, and a plurality of magazines each configured to hold a stack of the items. A pick and place machine includes a carriage for moving the pickers between a picking location adjacent the magazine and a placing location. The carriage includes a quick-release clamp assembly that allows pickers for different items to be changed quickly and without the use of tools. The magazines and product support plates upon which items are also configured to be changed without the use of tools.

16 Claims, 20 Drawing Sheets

QUICK-CHANGE TOOLING SYSTEM

CROSS-REFERENCE TO RELATED APPLICATIONS

This application is a §371 national phase filing of International Patent Application No. PCT/US08/71221, filed on Jul. 25, 2008, which claims the benefit of U.S. Provisional Patent Application No. 60/952,485, filed Jul. 27, 2007, the entire contents of which are incorporated by reference herein.

BACKGROUND

The invention relates to a quick change tooling system for vacuum operated manufacturing equipment, such as blister pack packaging machines.

When using a packaging device to package products that are mass produced, it is often necessary to reconfigure the packaging device every time there is a change either to the product or to the product packaging. Such reconfiguration may include changing components or repositioning components to handle the different product or product packaging. Unlike day-to-day machine operation, which can be accomplished by an untrained employee, reconfiguring the packaging device may require the skills of a highly trained technician. Also, time spent reconfiguring the packaging device means no products are being packaged, thereby reducing the profitability of the machine.

SUMMARY

A quick-change tooling system is provided for a pick and place packaging device. The system includes a plurality of pickers, each picker configured to pick a specific item, and a plurality of magazines, each magazine configured to hold a stack of the specific item. The pick and place device includes at least one picker holder and at least one magazine holder, and each of the plurality of pickers and each of the plurality of magazines can be selectively engaged with the picker holder and magazine holder without the use of tools to quickly reconfigure the pick and place device to pick and place different items.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
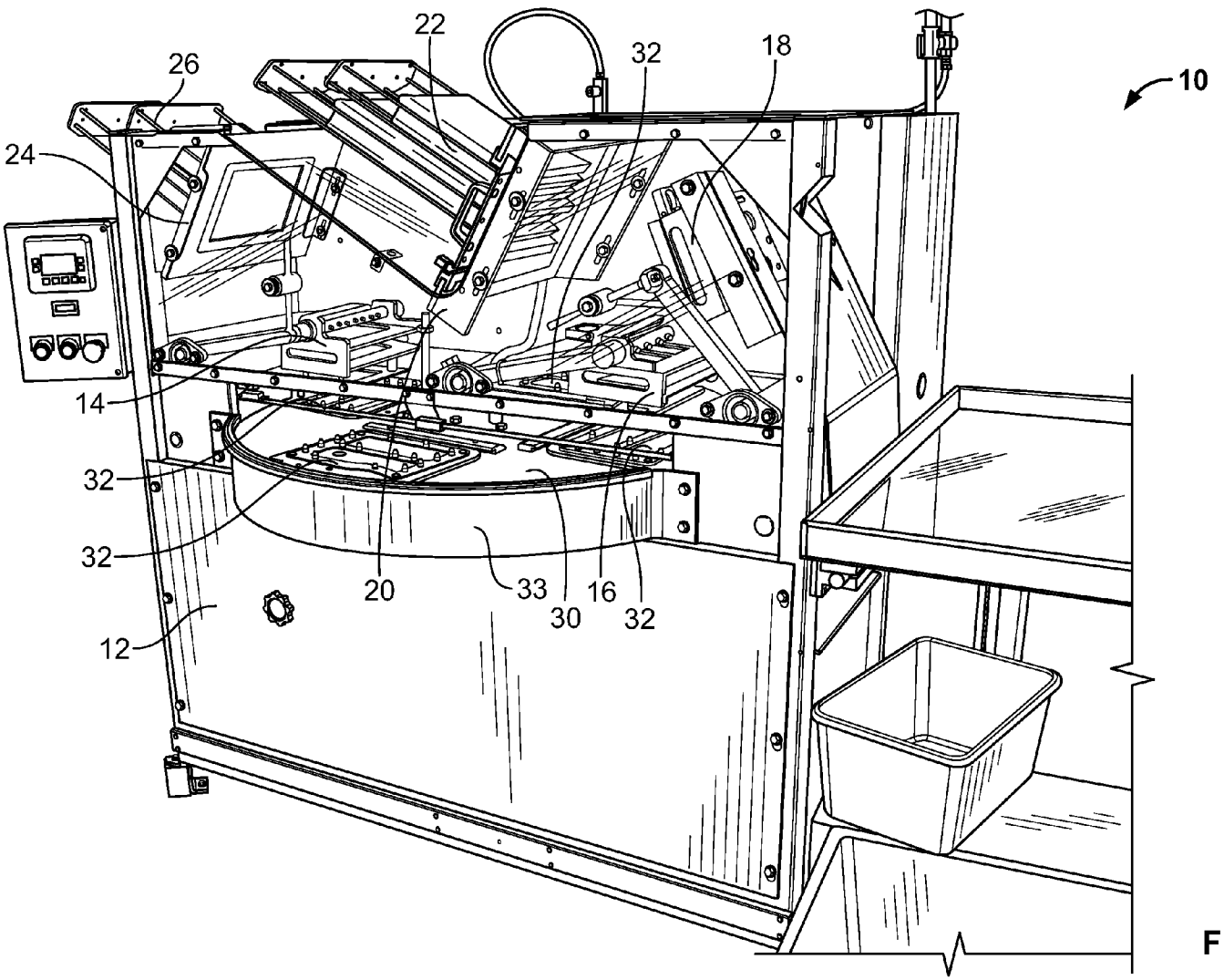
FIG. 1 is a perspective view of a packaging device including portions of the quick-change tooling system of the present invention.

FIG. 1 illustrates a pick and place packaging machine 10 for use with the quick-change tooling system of the present invention. In the illustrated embodiment, the packaging machine 10 is a Model 4S-CBE 4-station rotary heat seal machine manufactured by Alloyd Brands of DeKalb, Ill. The quick-change tooling system of the present invention can also be utilized with Alloyd Brands Model 4SM-6X9-CBE, which is also a 4-station rotary heat seal machine, Alloyd Brands Model 16S1216, which is a 16 station carousel heat seal machine, and Alloyd Brands Models 14SM89, and 14S-CBE, which are 14 station carousel heat seal machines. The quick change tooling system may also be utilized with similar heat seal machines that are available from Algus Packaging of Dekalb, Ill., and Starview Packaging Machinery of St. Laurent, QC, Canada. These are just a few specific examples of machinery that may be used in combination with the quick-change tooling system of the present invention, other applications involving other types and/or brands of machinery are also possible.

The illustrated packaging machine 10 includes a housing 12 for support of the various components of the packaging machine 10. The housing 12 supports a first carriage portion 14, a second carriage portion 16, and a third carriage portion 18 for translational and/or rotational movement between a picking position and a placing position, as discussed below. The housing 12 also supports a first magazine holder 20 that supports a first magazine 22, and a second magazine holder 24 that supports a second magazine 26. The magazine holders 20, 22 are positioned substantially adjacent to the picking positions of the first and second carriage portions 14, 16, respectively. The housing 12 also defines a heat seal station 28 and rotatably supports a turntable assembly 30. The turntable assembly 30 includes a plurality (e.g. four, as illustrated) of packaging stations 32 and rotates the packaging stations between the placing positions of the first and second carriage portions 14, 16, on each side of the machine 10, the heat seal station 28 at the rear of the machine 10, and an operator station 33 at the front of the machine 10.

Figure 2:
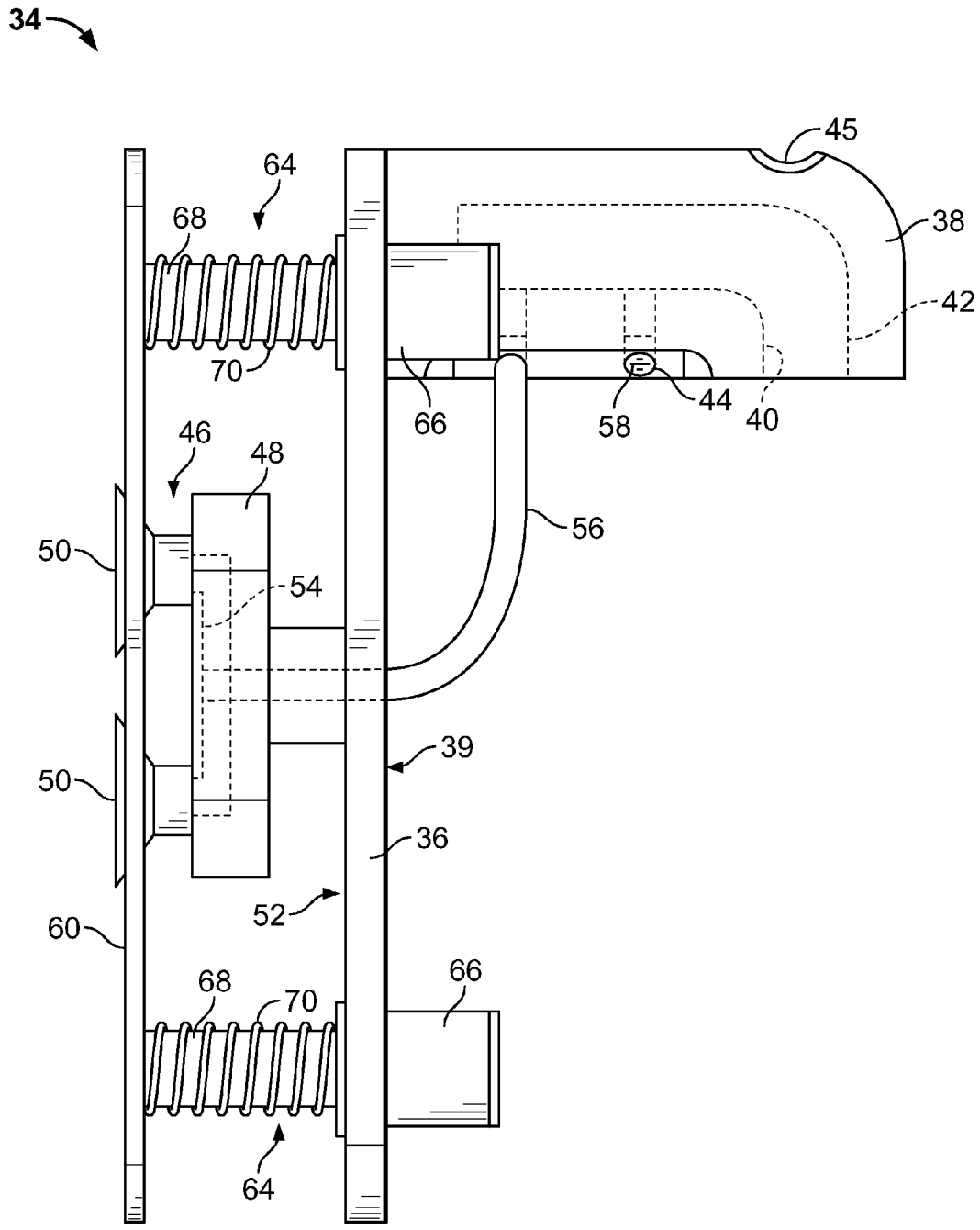
FIG. 2 is a side view of a card picker for the packaging device of FIG. 1.
Figure 3:
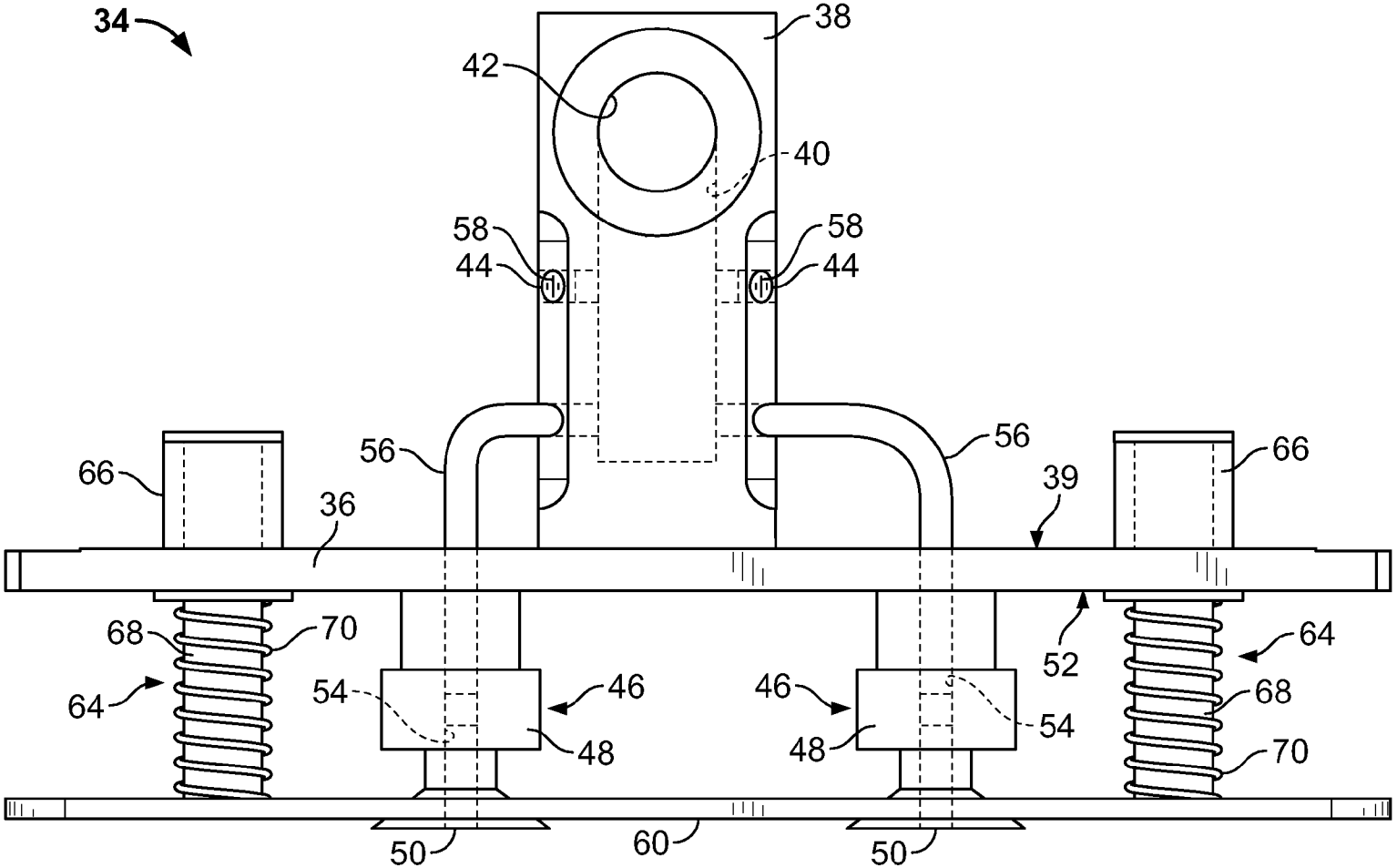
FIG. 3 is a bottom view of the card picker of FIG. 2.
Figure 4:
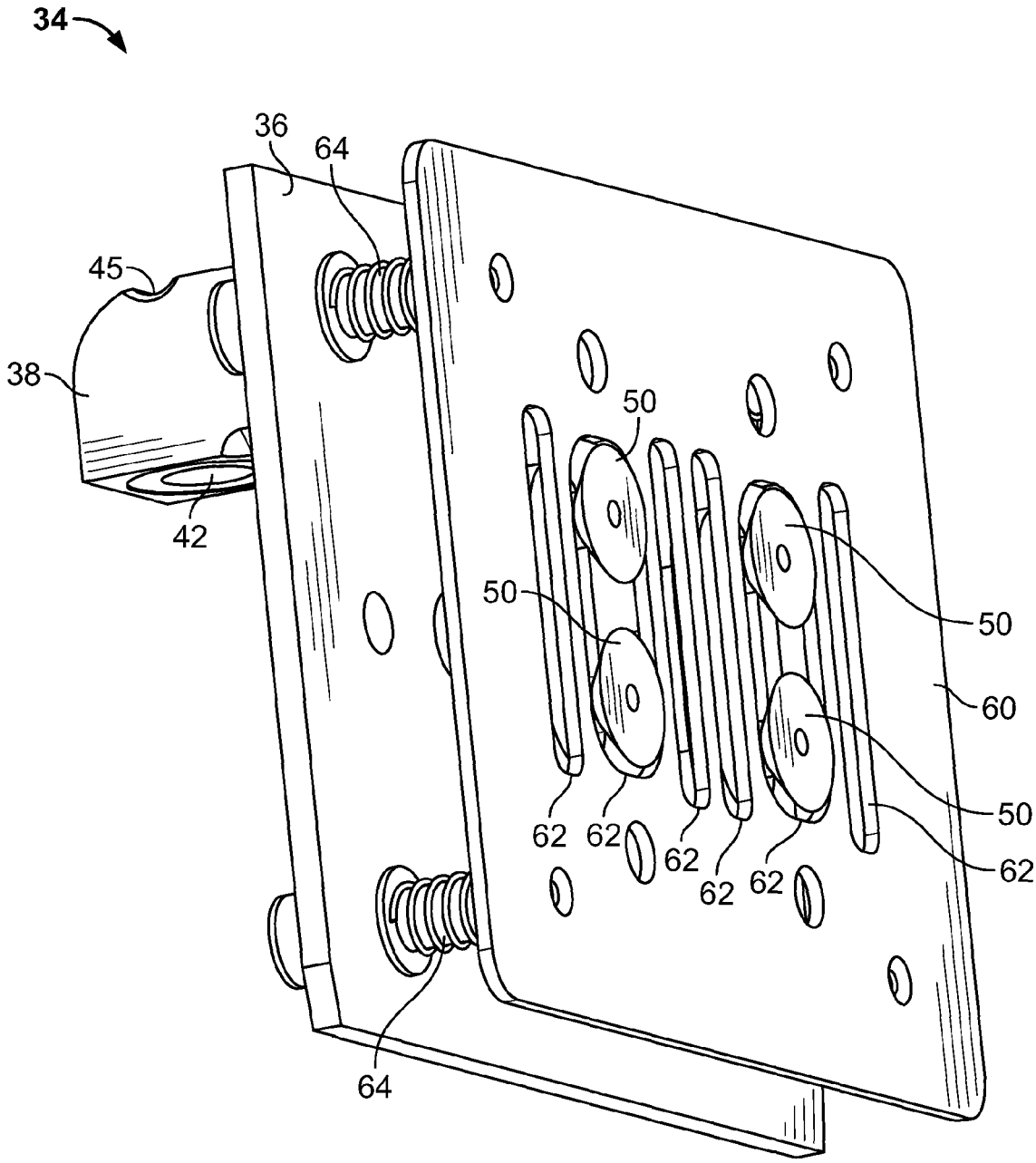
FIG. 4 is a perspective view of the card picker of FIG. 2.

FIGS. 2-4 illustrate a card picker 34 that can be coupled to any of the first, second or third carriage portions 14, 16, 18. The card picker 34 includes a mounting plate 36 to which the remaining components of the card picker 34 are coupled. A picker manifold 38 is coupled to a first side 39 of the mounting plate 36 and defines a chamber 40. The chamber 40 includes an inlet 42 at one end of the manifold 38 and a plurality of outlet openings 44 defined along the length of the manifold 38. The manifold 38 also defines a concave recess 45 positioned opposite the inlet 42, which facilitates coupling of the card picker 34 to one of the carriage portions 14, 16, 18, as discussed below.

The card picker 34 also includes a pair of picking members in the form of suction cup assemblies 46. Each suction cup assembly 46 includes a body 48 and a pair of suction cups 50. The body 48 is coupled a second side 52 of the mounting plate 36 and cooperates with the mounting plate 36 to define a fluid passageway 54 that extends between the first side 39 and the suction cups 50. Conduit in the form of lengths of tubing 56 extend between the outlet openings 44 and the first side 39 of the mounting plate 36 to fluidly couple the fluid passageways 54 defined by the mounting plate 36 and bodies 48 to the chamber 40 of the picker manifold 38. In the illustrated embodiment, there are two suction cup assemblies 46 and therefore only two of the outlet openings 44 are utilized. Plugs 58 are inserted into the unused outlet openings 44 to prevent loss of vacuum within the chamber 40.

The card picker 34 also includes a picking plate 60 that is spaced from and substantially parallel to the mounting plate 36. The picking plate 60 defines a plurality of apertures 62, some of which receive the suction cups 50. The picking plate 60 is coupled to the mounting plate 36 by biasing assemblies 64. Each biasing assembly 64 includes a bushing 66 coupled to the mounting plate 36, a shaft 68 coupled to the picking plate 60 and received by and axially moveable within the bushing 66, and a spring 70 that biases the picking plate 60 away from the mounting plate 36.

Figure 5:
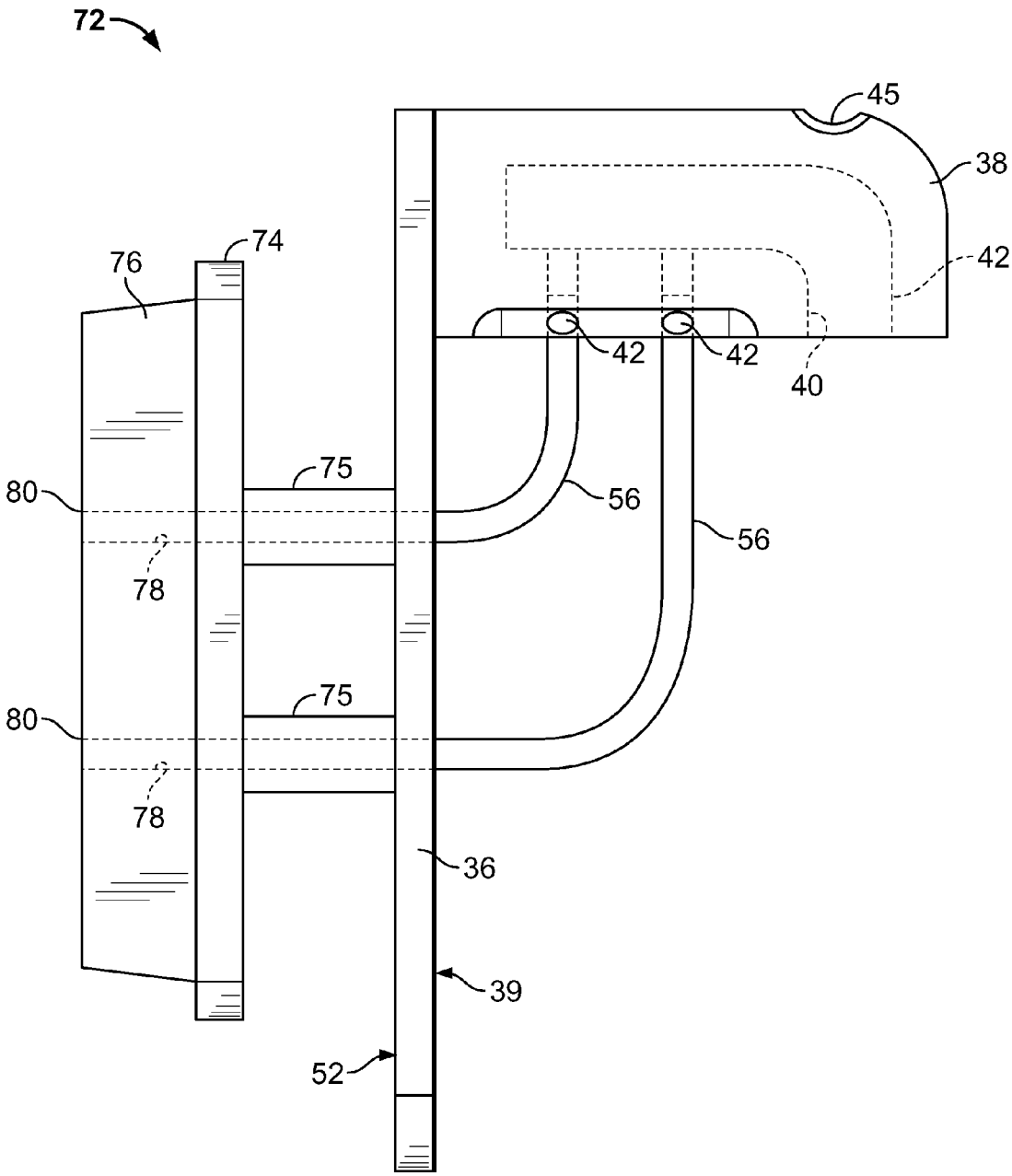
FIG. 5 is a side view of a blister picker for the packaging device of FIG. 1.
Figure 6:
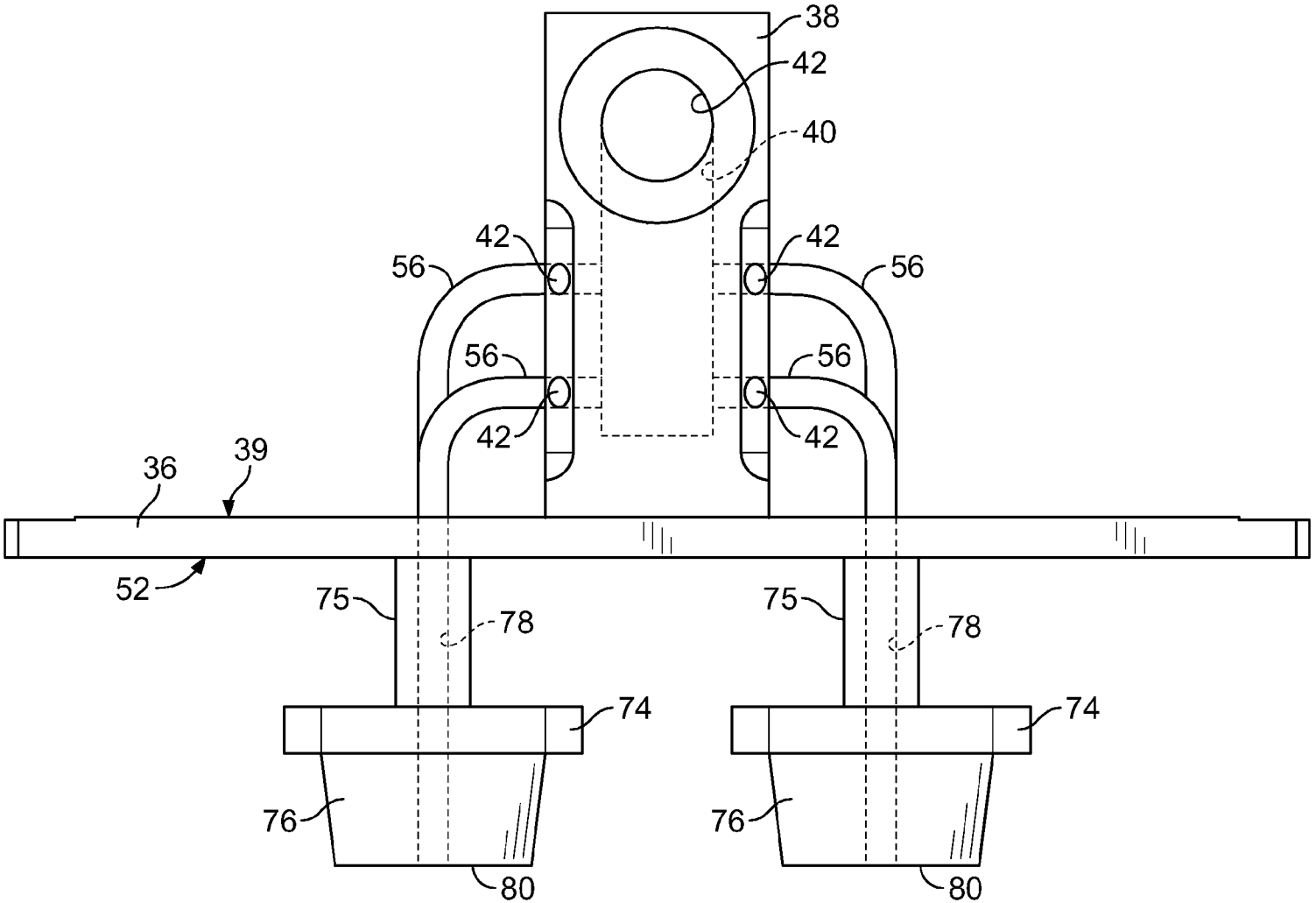
FIG. 6 is a bottom view of the blister picker of FIG. 5.
Figure 7:
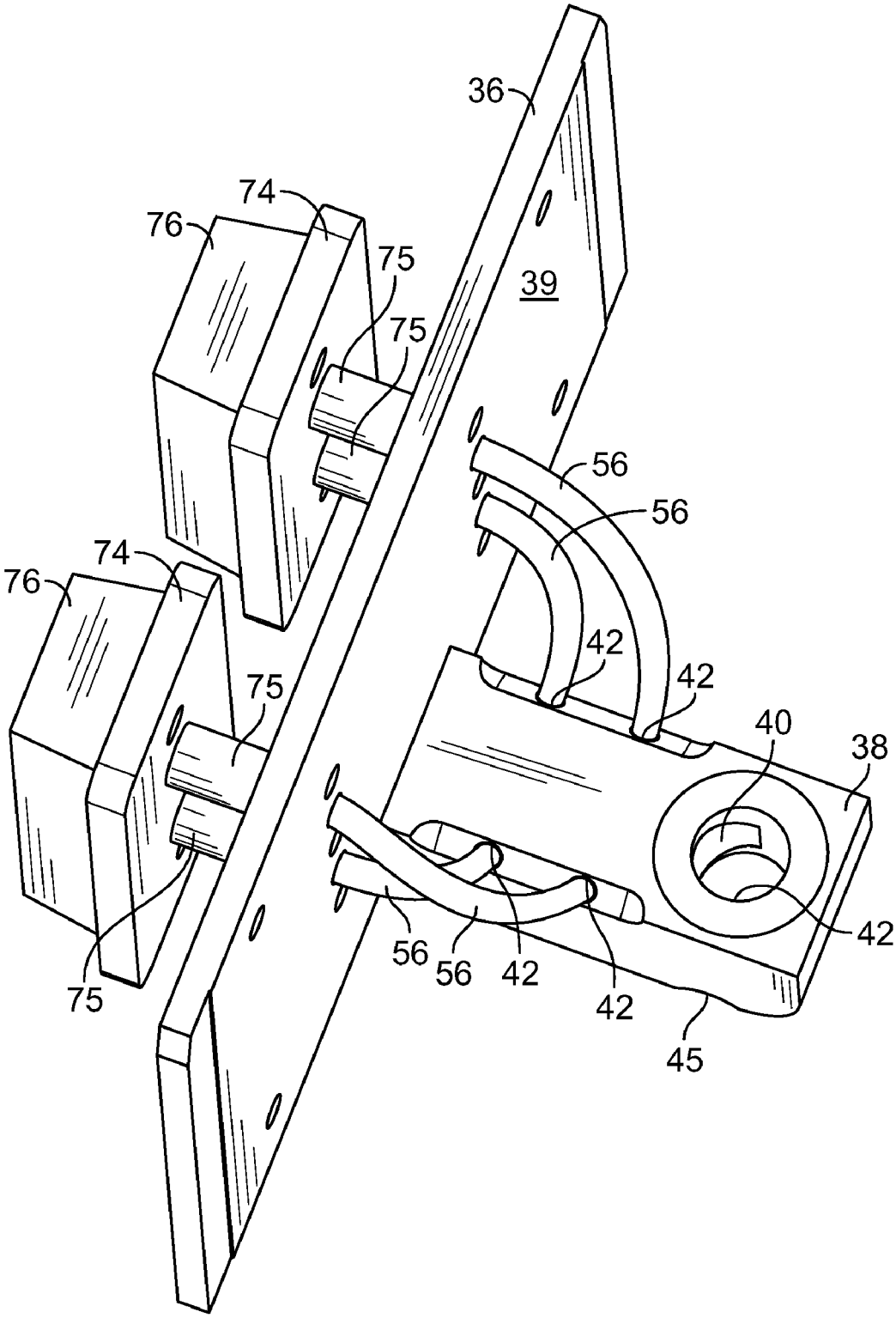
FIG. 7 is a perspective view of the blister picker of FIG. 5.

FIGS. 5-7 illustrate a blister picker 72 that, like the card picker 34, can be coupled to any of the first, second, or third carriage portions 14, 16, 18. The blister picker 72 is configured similarly to the card picker 34 and includes an identical manifold 38 and a mounting plate 36 having the same outer dimensions as the mounting plate 36 of the card picker 34, but which may have a different arrangement of apertures, for reasons discussed below. The blister picker 72 includes picking members in the form of two gripper portions 74 coupled to the second side 52 of the mounting plate 36 by standoffs 75. The gripper portions 74 include protrusions 76 that are sized and shaped to fit within a recess defined by a package blister (not shown). Like the bodies 48 of the suction cup assemblies 46, the gripper portions 74 cooperate with the mounting plate 36 to define fluid passageways 78 that extends from the first side 39 of the mounting plate 36 to openings 80 in the protrusions 76. Lengths of tubing 56 extend from the outlet openings 44 of the picker manifold 38 to the first side 39 of the mounting plate 36 to fluidly couple the fluid passageways 54 to the chamber 40 of the picker manifold 38. Because each outlet opening 44 is utilized in the blister picker 72, the plugs 58 employed in the card picker 34 (FIGS. 2 and 3) are not required.

The illustrated card picker 34 and blister picker 72 are both configured to pick a particular type of card and a particular type of blister. For example, the size, location, number, and orientation of the suction cups 50 on the card picker 34 are selected for picking and placing a specific type, size, and material card (not shown). Picking and placing a different type of card may require different sizes, locations, numbers, or orientations of suction cups 50. Similarly, picking and placing different sizes and shapes of blisters may require the use of different gripper portions 74. To this end, a plurality of card pickers 34 and a plurality of blister pickers 72 are provided, with each individual card or blister picker 34, 72 configured to pick and place a particular type of card or blister. While the size, shape, number and orientation of the suction cups 50 and gripper portions 74 may change, each card or blister picker 34, 72 includes the same type of picker manifold 38 and includes a mounting plate 36 with identical outer dimensions and thickness. In this way, the card and blister pickers 34, 72 may be quickly and easily interchanged with one another when the packaging device 10 is reconfigured for packaging of different products.

Figure 8:
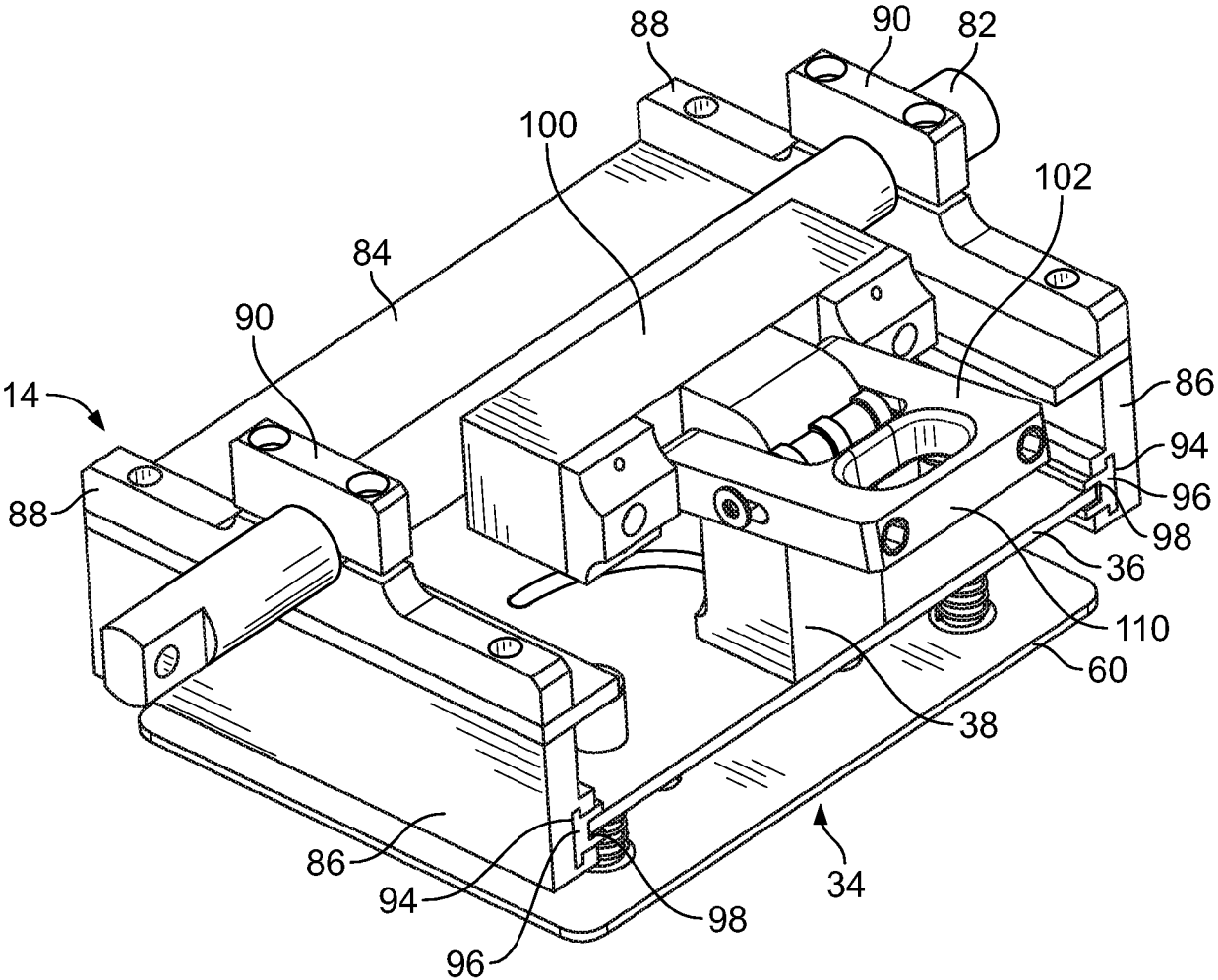
FIG. 8 is a perspective view of a carriage portion of the packaging device of FIG. 1, with the card picker of FIG. 2 coupled thereto.
Figure 9:
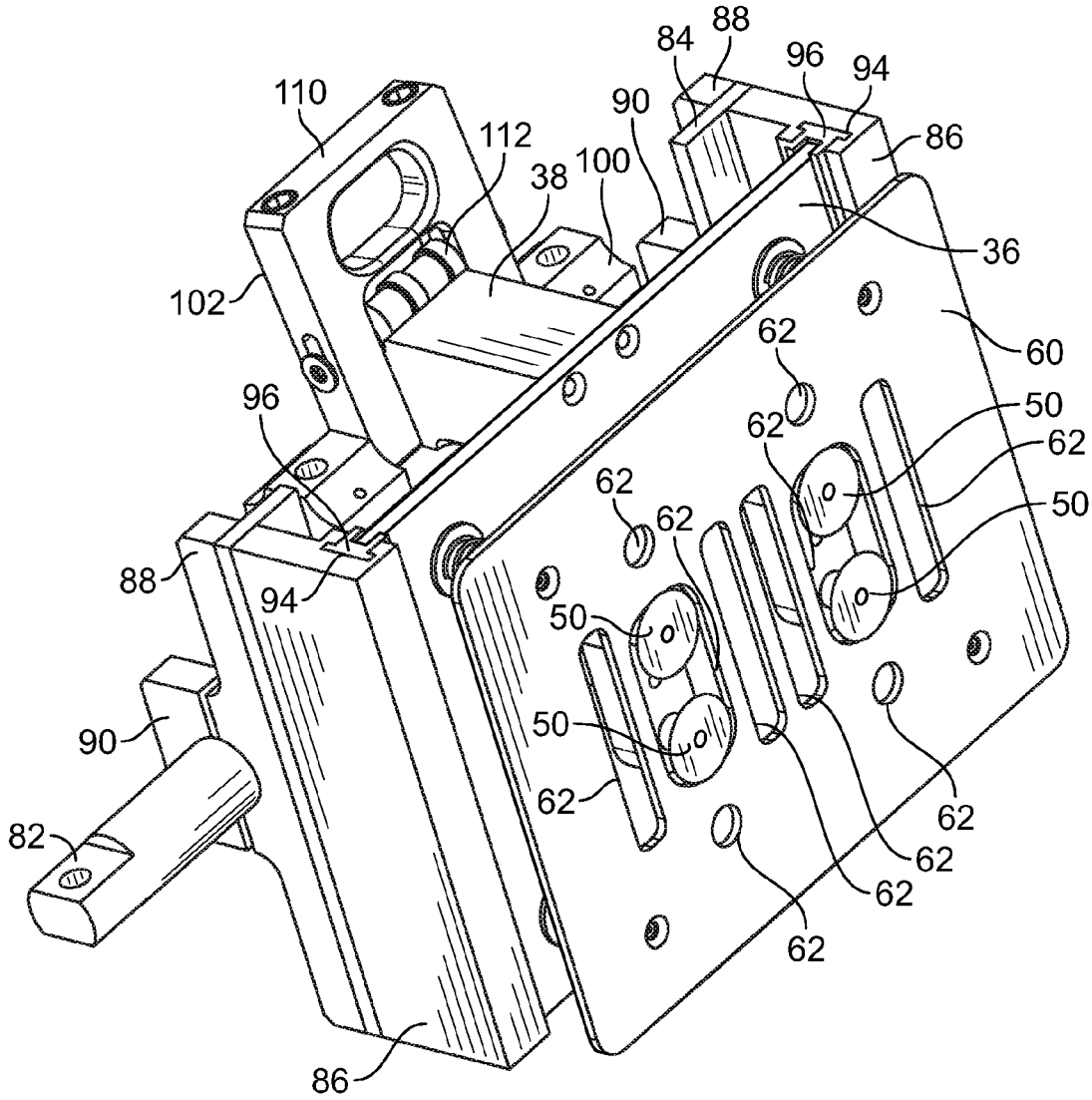
FIG. 9 is another perspective view of the carriage portion and card picker of FIG. 8.
Figure 10:
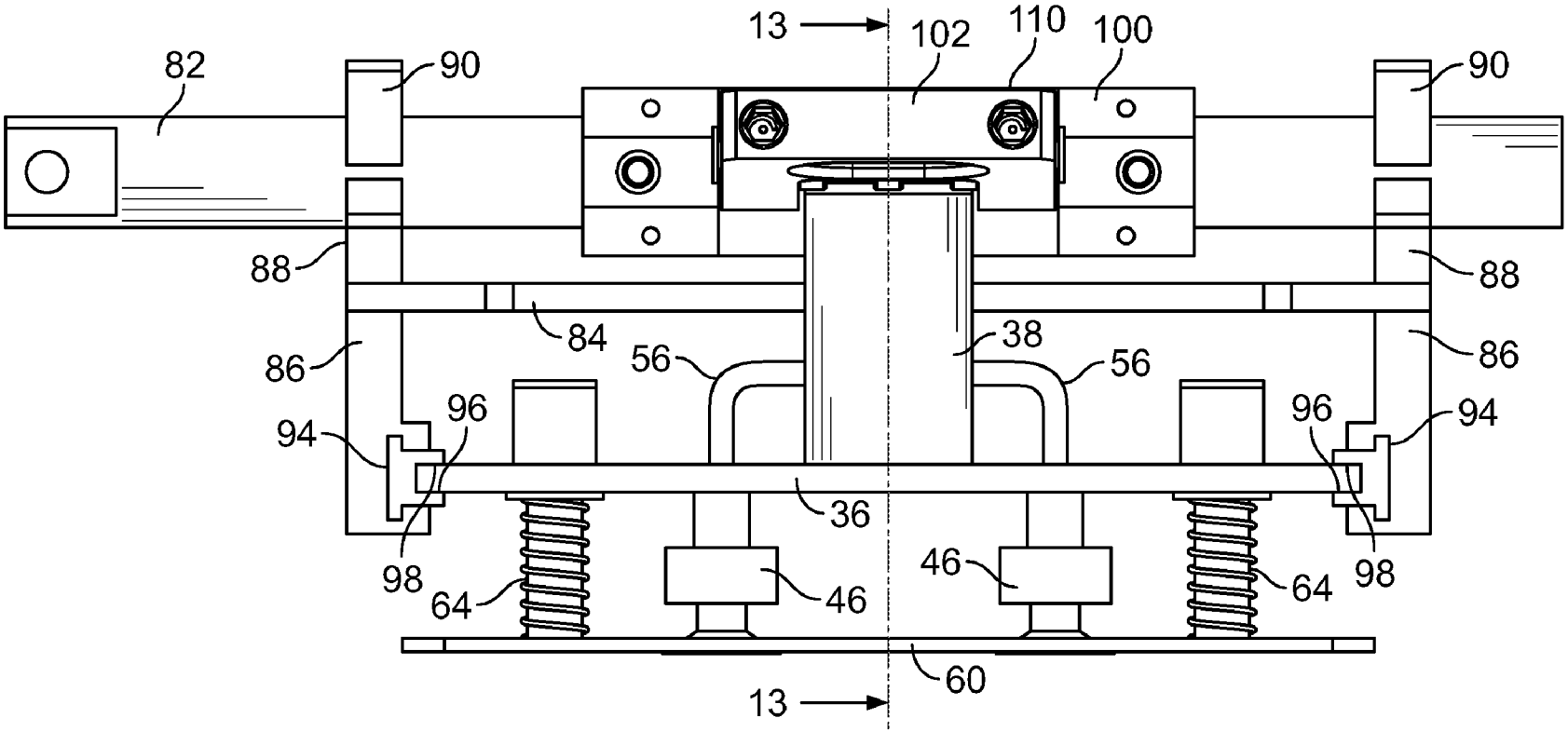
FIG. 10 is a top view of the carriage portion and card picker of FIG. 8.

FIGS. 8-10 illustrate the card picker 34 coupled to one of the carriage portions 14, 16, 18. Each carriage portion 14, 16, 18 is substantially identical to the other carriage portions 14, 16, 18. For the sake of brevity, the invention is discussed below with reference to the first carriage portion 14. It should also be appreciated that the description below regarding coupling of the card picker 34 to the carriage portion 14 is equally applicable to coupling of the blister picker 72 to the carriage portion 14 (or to the carriage portions 16, 18).

The carriage portion 14 includes a support shaft 82 that is coupled to the housing 12 by a linkage and drive system (not shown) that moves the support shaft 82, and therefore the carriage portion 14 along a predetermined path for picking and placing operations. The carriage portion 14 also includes a generally U-shaped frame plate 84, a pair of side supports 86 coupled to opposite ends of the frame plate 84, and a pair of clamping blocks 88 also coupled to the ends of the frame plate 84 on a side opposite the side supports 86. The clamping blocks 88 define recesses that receive one side of the support shaft 82, and a pair of clamps 90, also defining recesses, are positioned over the opposite side of the support shaft 82 and coupled to the clamping blocks 88. The clamps 92 and clamping blocks 88 cooperate to rigidly couple the frame plate 84 and side supports 86 to the support shaft 82 for movement therewith.

Each side support 86 defines an inwardly facing, generally T-shaped slot 94. The slots 94 receive elongated guides 96 made from a lightweight, low-friction plastic, such as DELRIN, which is sold and distributed by E.I. DuPont. Each guide 96 defines a slot 98 sized to receive the mounting plate 36. In this way the mounting plate 36 of any card picker 34 (or blister picker 72) can be quickly slid into place between the side supports 86 for movement with the carriage portion 14.

Figure 11:
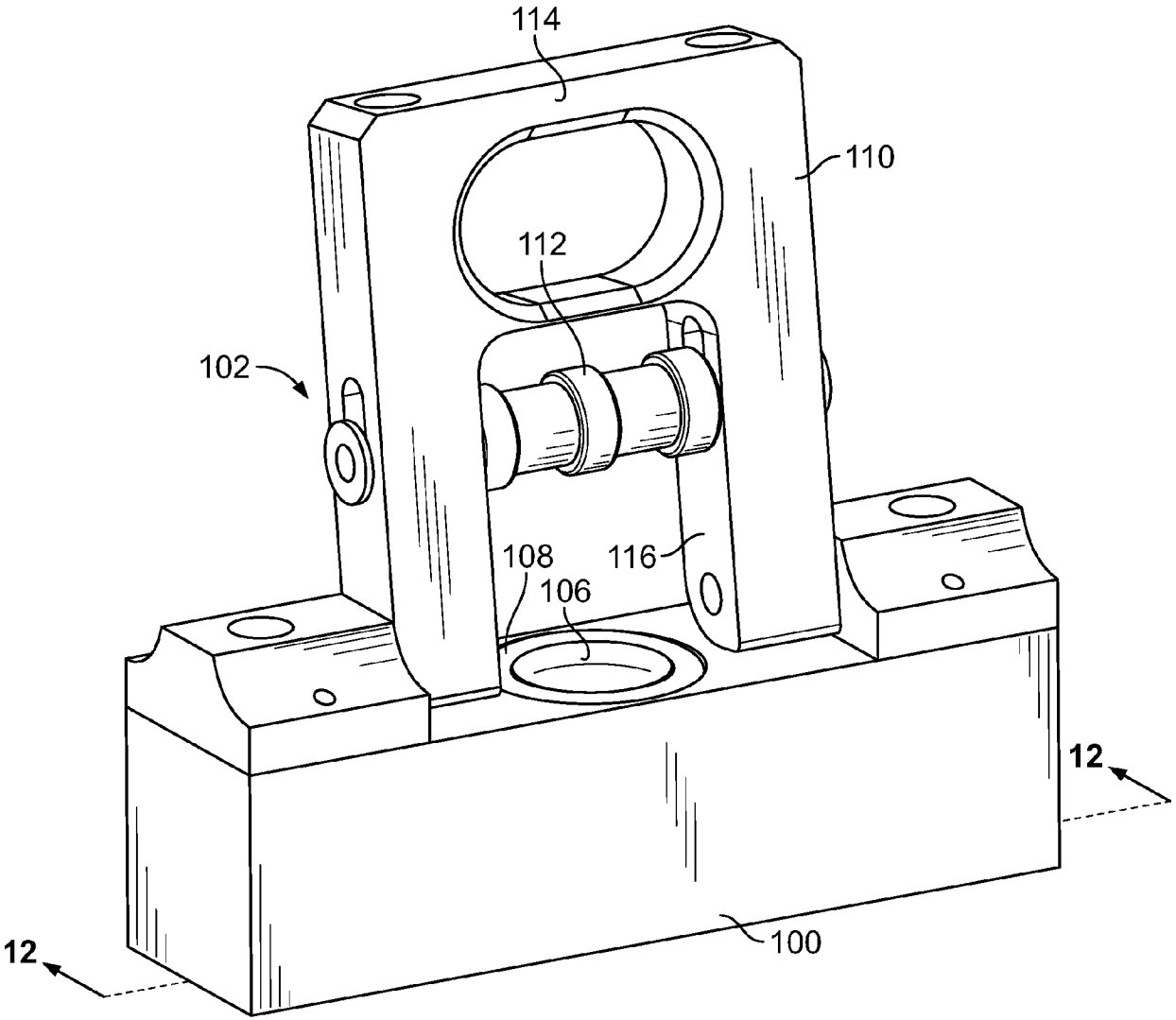
FIG. 11 is a perspective view of a handle and manifold assembly of the carriage portion of FIG. 8.
Figure 12:
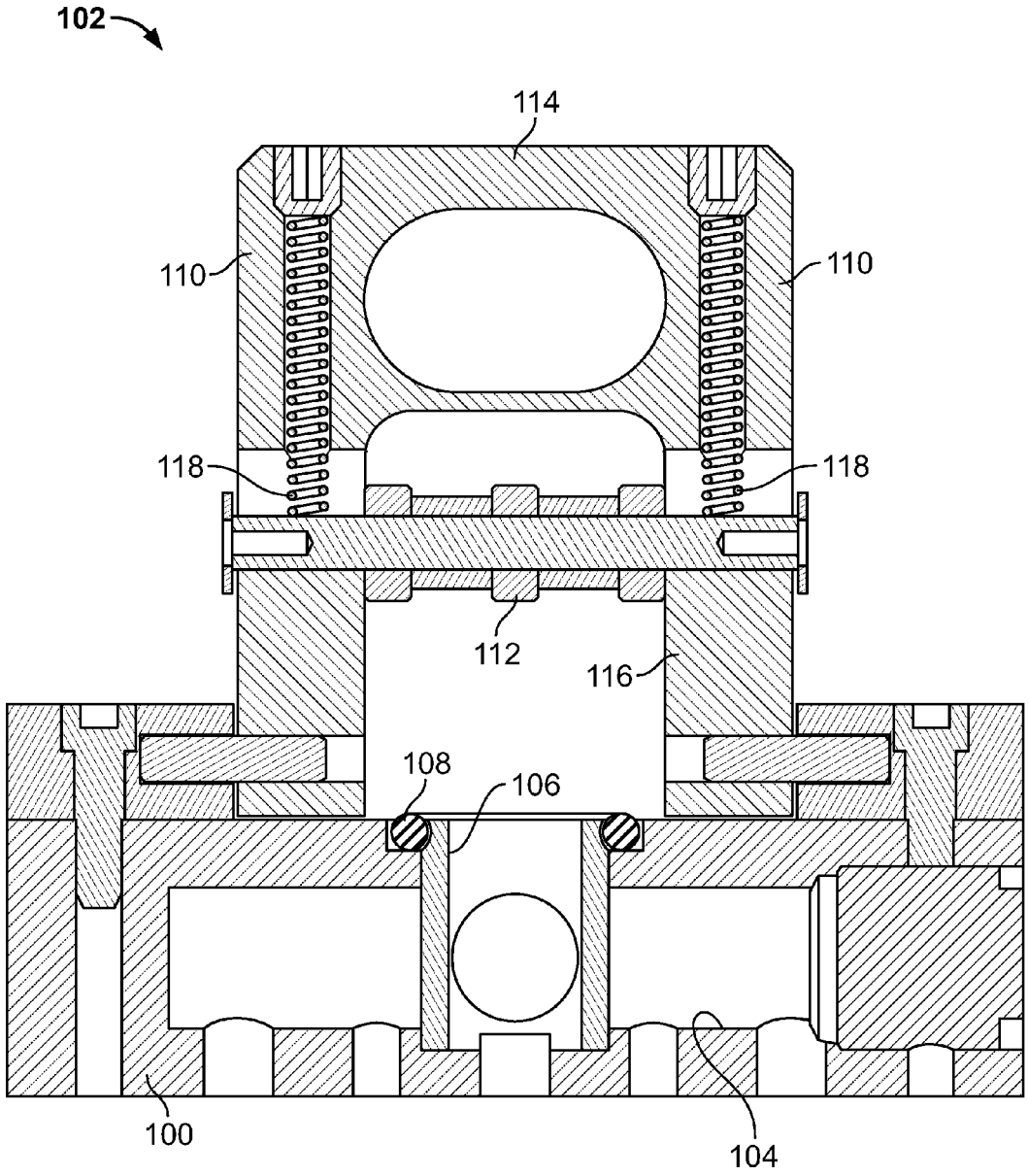
FIG. 12 is a section view taken along line 12-12 of FIG. 11.
Figure 13:
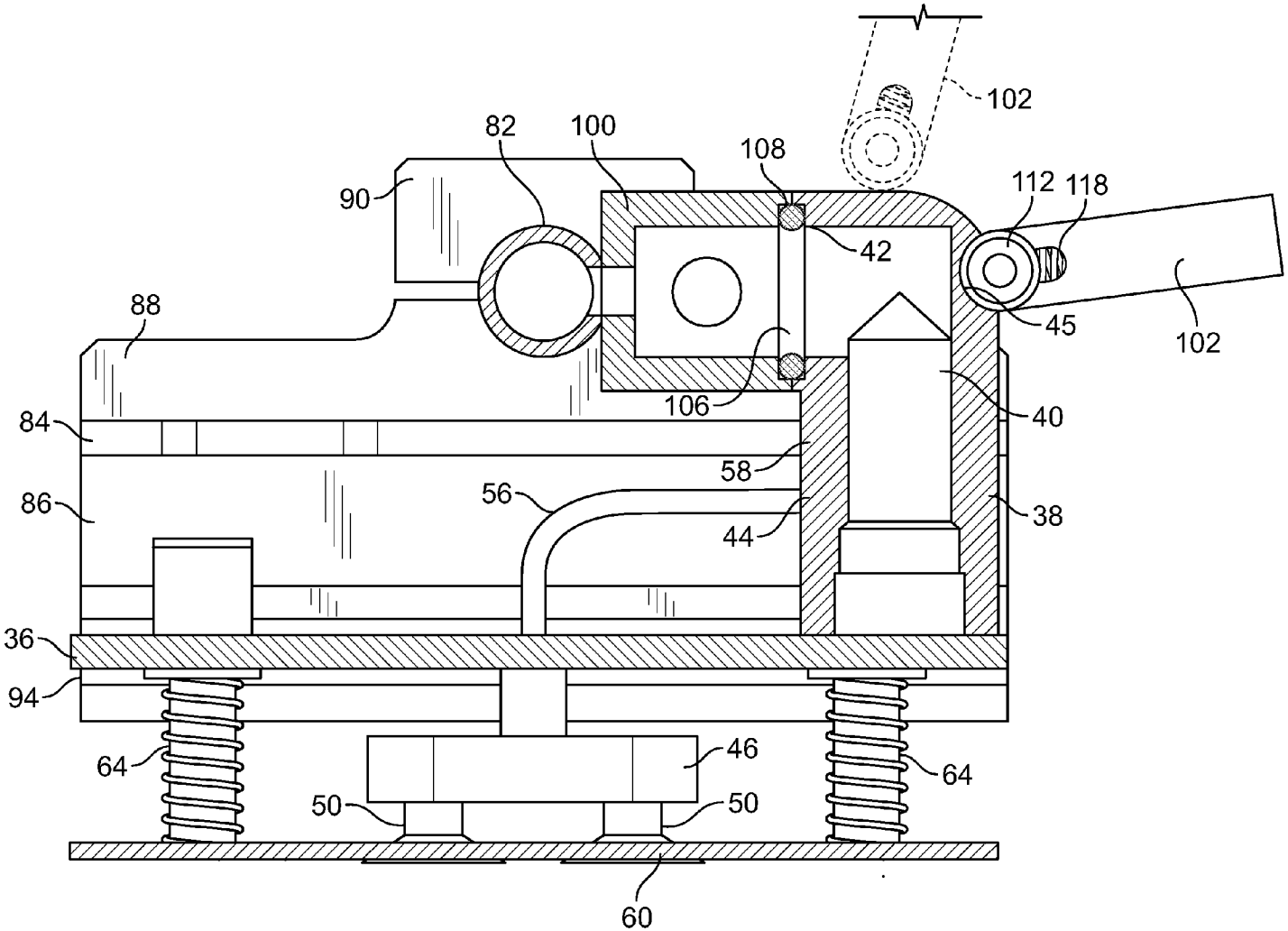
FIG. 13 is a section view taken along line 13-13 of FIG. 10.

Referring also to FIGS. 11-13, the carriage portion 14 also includes a carriage manifold 100 and a clamp assembly 102. The carriage manifold 100 is coupled to a vacuum source (not shown) on the packaging device 10 and is configured for quick-connect engagement with the inlet 42 of the picker manifold 38 of any card or blister picker 34, 72. The carriage manifold 100 defines a chamber 104 including an opening 106 that is surrounded by an O-ring 108. The O-ring 108 sealingly engages the inlet 42 of the picker manifold 38 when the card picker 34 is slid into place between the side supports 86 and the clamp assembly 102 is engaged (see FIG. 13). Vacuum in the carriage manifold 100 can then be communicated through the picker manifold 38, through the lengths of tubing 56, and through the fluid passageways 54 (or fluid passageways 78, in the case of the blister picker 72) for picking operations.

The clamp assembly 102 includes a handle 110 that is pivotally coupled to the carriage manifold 100. The handle 110 includes a roller assembly 112 positioned between a grip portion 114 and a pivot portion 116. The roller assembly 112 is biased by springs 118 toward the pivot portion 116. When a card or blister picker 34, 72 is initially slid into place between the side supports 86, the handle 110 is in a disengaged position (illustrated in phantom in FIG. 13). The handle 110 is then pivoted toward an engaged position (e.g. clockwise in FIG. 13) so that the roller assembly 112 engages the curved portion of the picker manifold 38. Continued pivotal movement of the handle 110 urges the roller assembly toward the grip portion 114 against the biasing force of the springs 118 until the roller assembly 112 is received by the concave recess 45 and the handle 110 detently snaps into the engaged position illustrated in FIG. 13. The springs 118 detently retain the handle 110 in the engaged position and also urge the picker manifold 38 into sealing engagement with the O-ring 108 of the carriage manifold 100.

To change card or blister pickers for the handling of different packaging products, the handle 110 is pivoted to the disengaged position and the existing card or blister picker is slid outwardly from between the side supports (e.g. to the right in FIG. 13). The alternate card or blister picker is then slid into place between the side supports and the handle 110 is pivoted to the engaged position. In this way card or blister pickers may be quickly and easily exchanged, thereby reducing the amount of downtime for the packaging device 10.

Figure 14:
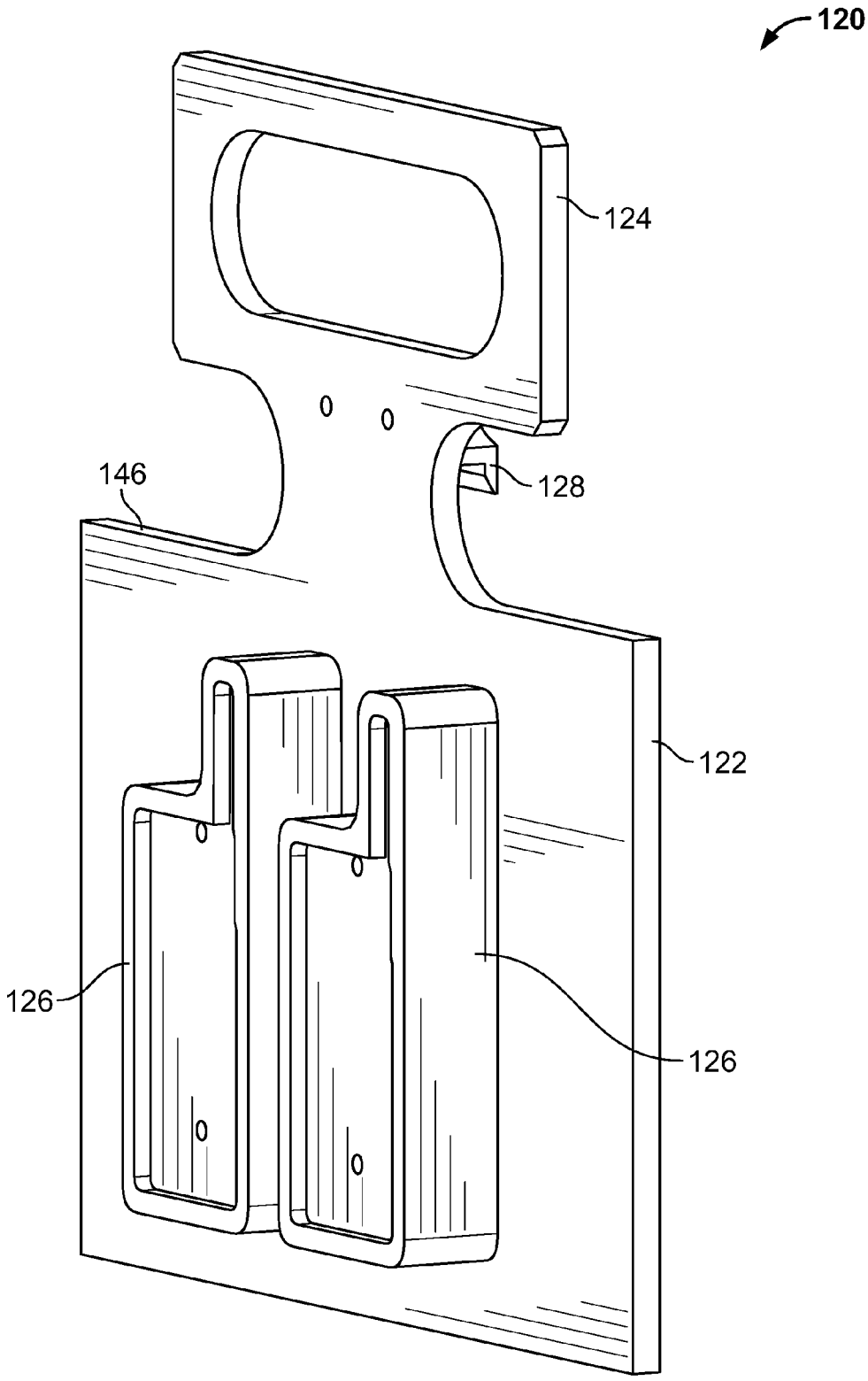
FIG. 14 is a perspective view of a heat seal plate heater of the packaging device of FIG. 1.

FIG. 14 illustrates a heat seal plate heater 120 that is part of the heat seal station 28. Like the card picker 34 and the blister picker 72, the heat seal plate heater 120 is configured to be quickly and easily changed from one configuration to another to reduce downtime for the packaging device 10. The plate heater 120 includes a generally rectangular plate 122 having a handle 124. A pair of heater blocks 126 are coupled to the plate 122 and are sized and configured to apply heat to a heat seal card (not shown) for sealing the blister package. The shape and configuration of the heater blocks 126 will change depending upon the particular size and type of heat seal card being utilized. The plate heater 120 also includes a generally L-shaped upper catch 128 coupled to the plate 122 adjacent the handle 124 and on a side opposite the heater blocks 126.

Figure 15:
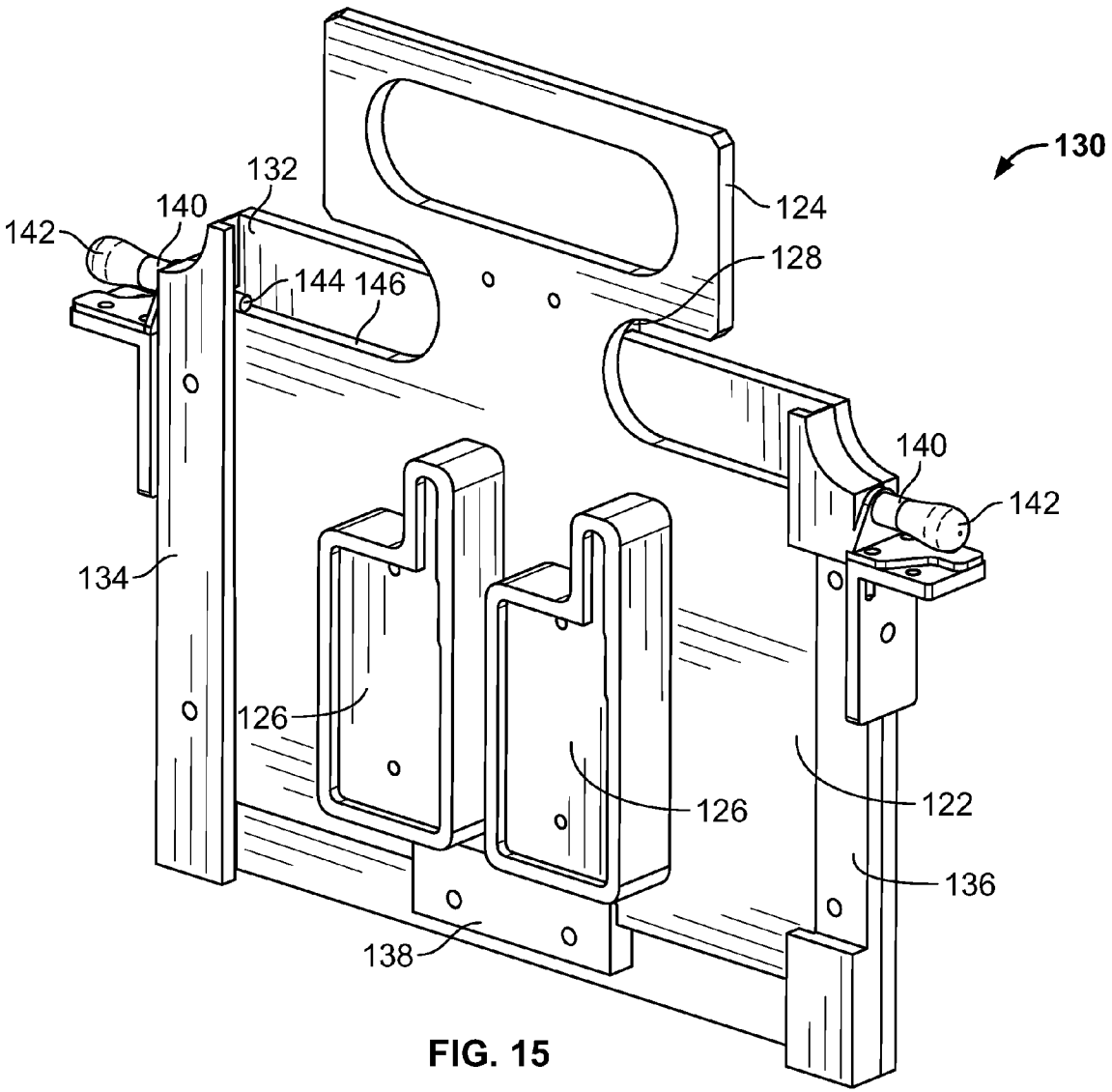
FIG. 15 is a perspective view of a heat seal plate heater carriage of the packaging device of FIG. 1, with the heat seal plate heater of FIG. 14 coupled thereto.
Figure 16:
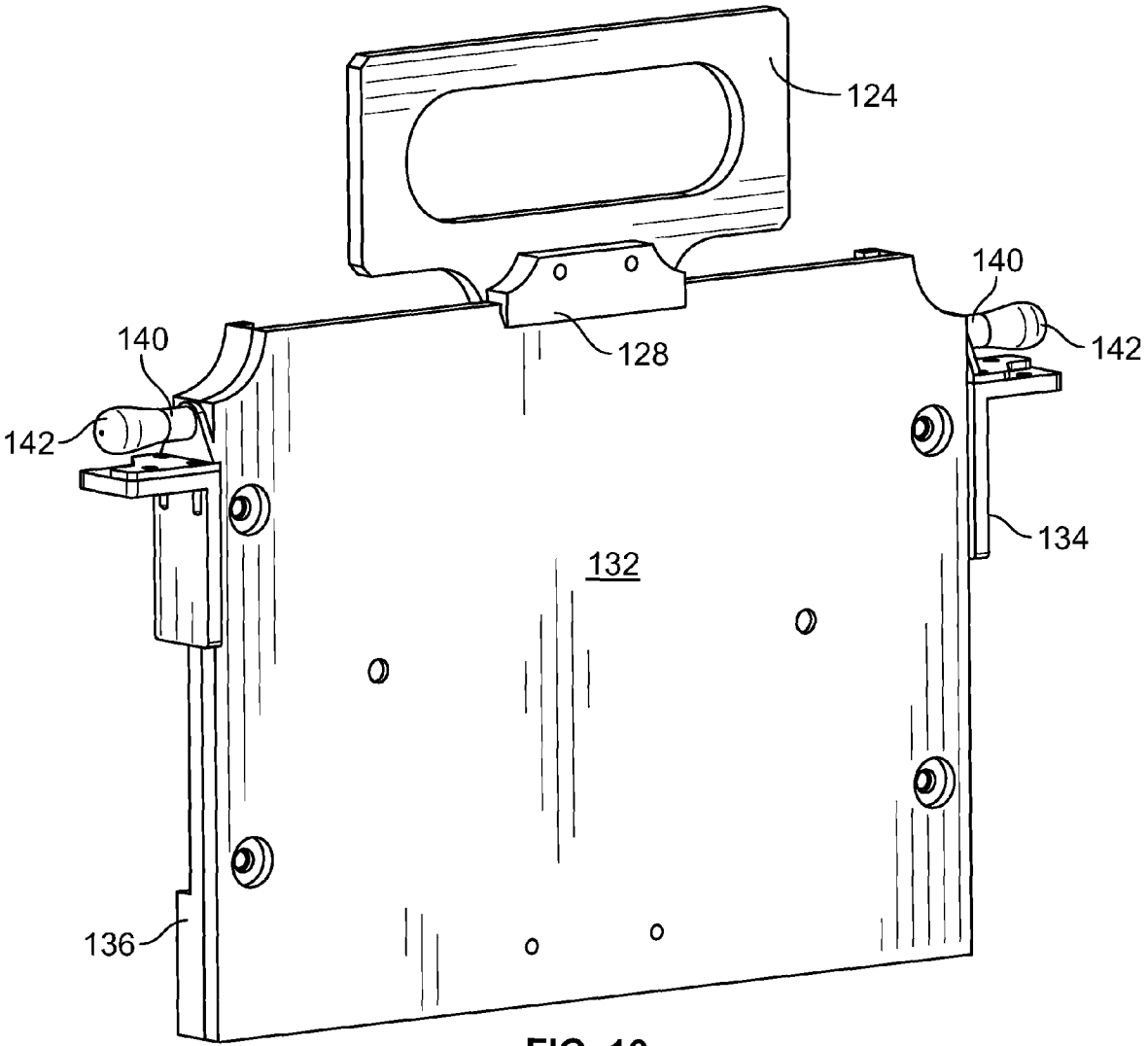
FIG. 16 is another perspective view of the heat seal plate heater carriage and heat seal plate heater of FIG. 15.

FIGS. 15 and 16 illustrate the plate heater 120 received by a heater carriage 130, which is positioned within the heat seal station 28. The heater carriage 130 includes a backing plate 132, a first side guide 134, and a second side guide 136. The plate heater 120 is slidingly received between the first and second side guides 134, 136. A generally L-shaped lower catch 138 is coupled to the backing plate 132 and, along with the upper catch 128, longitudinally positions the plate heater 120 with respect to the heater carriage 130.

Locking pins 140 are slidingly coupled to each of the first and second side guides 134, 136. Each locking pin 140 includes a handle portion 142 and a pin portion 144. The locking pins 140 are biased inwardly so that the pin portions engage and capture an upper edge 146 of the plate heater 120 when the plate heater 120 is positioned within the heater carriage 130.

Figure 17:
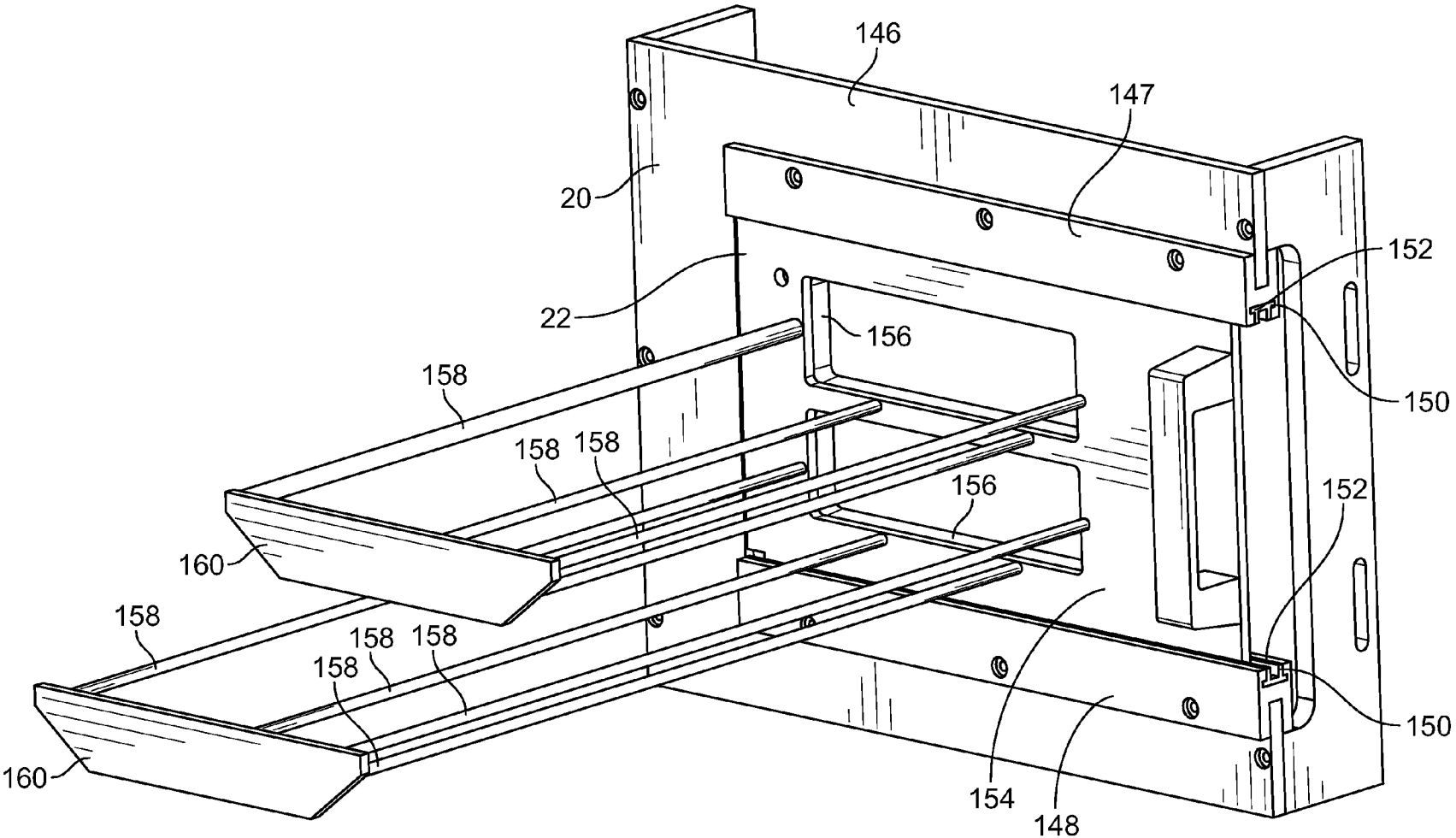
FIG. 17 is a perspective view of a first magazine coupled to a slide-in magazine holder of the packaging device of FIG. 1.

FIG. 17 illustrates the first magazine 22 supported by the first magazine holder 20. The first magazine holder 20 includes a generally rectangular frame 146 including upper and lower guideways 147, 148. Each guideway 147, 148 includes a generally T-shaped slot 150 that receives an elongated guide 152 that is similar in construction to the elongated guides 96. The first magazine holder 20 is fixed to the packaging device 10, and the first magazine 22 is configured to be quickly installed and removed from the first magazine holder 20 by sliding it into and out of the elongated guides 96. In this way, different magazines 22 can be quickly installed and removed to reduce the downtime of the packaging machine.

The first magazine 22 includes a support plate 154 that defines apertures 156 through which product (not shown) such as cards or blisters can be picked by the card picker 34 or blister picker 72. Support rods 158 extend generally perpendicularly from the support plate 154 to support the stack of products. An end plate 160 couples the distal ends of the support rods 158 to one another. The size, shape, orientation, and configuration of the apertures 156 and the support rods 158 may vary for magazines 22 that are configured for different products. The first magazine 22 and first magazine holder 20 are configured so that the first magazine 22 can be installed and removed from the front of the packaging machine 10.

Figure 18:
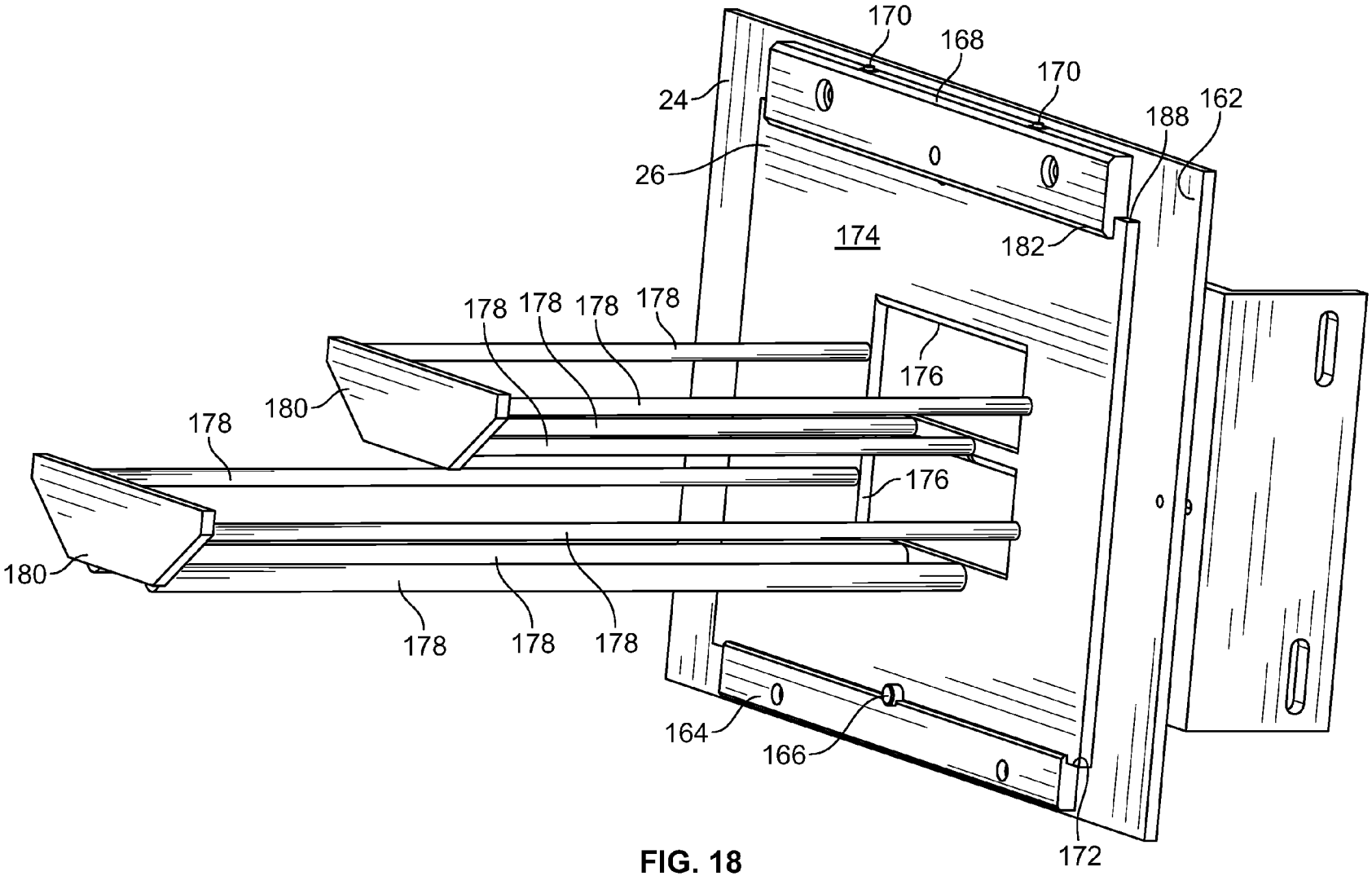
FIG. 18 is a perspective view of a second magazine coupled to a lock-in magazine holder of the packaging device of FIG. 1.

FIG. 18 illustrates the second magazine 26 supported by the second magazine holder 24. The second magazine holder 24 includes a generally rectangular frame 162, a lower support plate 164 including a central positioning pin 166, and an upper support plate 168 including biasing members 170 that engage the second magazine 26 and bias the second magazine 26 against the lower support plate 164 and positioning pin 166. The lower support plate 164 also includes a lip 172 that retains the second magazine 26 in mating engagement with the frame 162.

The second magazine 26 includes a plate 174 defining apertures 176 through which product can be picked by the card or blister pickers 34, 72. The second magazine 26 also includes support rods 178 that extend generally perpendicularly from the plate 174, and end plates 180 that couple distal ends of the support rods 178 to one another Like the first magazine 22, the size, shape, orientation and configuration of the apertures 176 and support rods 178 of the second magazine 26 may vary depending on what type of product the second magazine 26 is configured to support.

Figure 19:
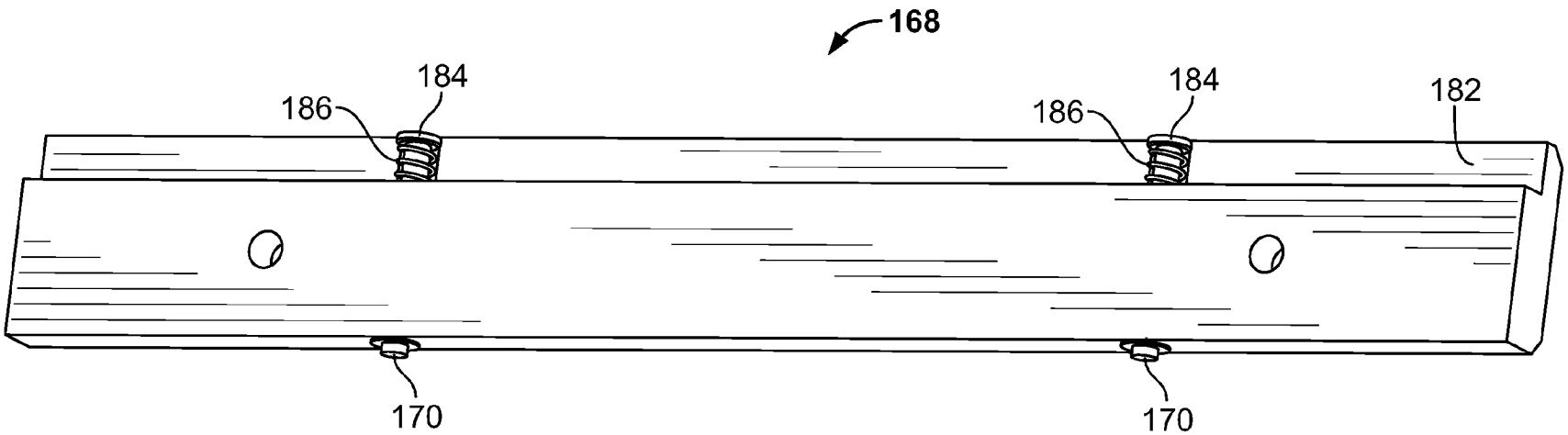
FIG. 19 is a perspective view of a lock-in plate for the lock-in magazine holder of FIG. 18.

FIG. 19 illustrates the upper support plate 168 in further detail. The upper support plate 168 defines a lip 182 that receives an edge of the plate 174 of the second magazine 26. A pair of pins 184 extend into the recess defined by the lip 182 and are biased outwardly by springs 186. To install a second magazine 26 into the second magazine holder 24, an upper edge 188 of the plate 174 is inserted under the lip 182 and the plate 174 is urged upwardly, against the biasing force of the springs 186. The plate 174 may then be pivoted downwardly so that the plate 174 engages the frame 162 of the magazine holder 24 and clears the lip 172 of the lower support plate 164. The biasing force of the springs 186 then urges the plate 174 downwardly so that the plate 174 is captured by the lip 172 and engages the positioning pin 166. To remove the second magazine 26, the magazine is urged upwardly and pivoted away from the frame 162. The second magazine 26 and second magazine holder 24 are configured so that differently configured second magazines 26 can be installed from the side or the top of the packaging device 10.

Figure 20:
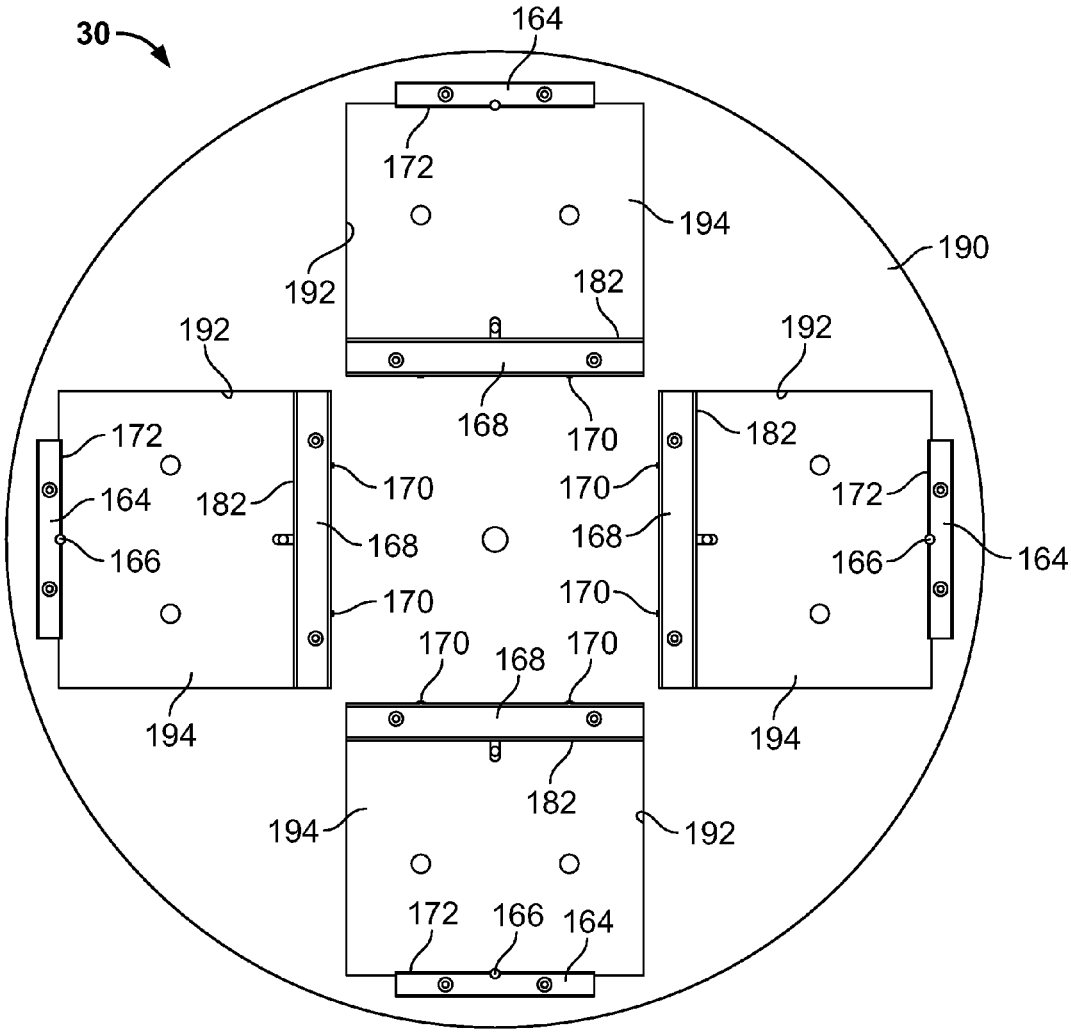
FIG. 20 is a top view of a turntable assembly for the packaging device of FIG. 1.

FIG. 20 illustrates the turntable assembly 30. The turntable assembly 30 includes a base 190 having four openings 192 that receive product support plates 194. The product support plates 194 can include a variety of pins, protrusions, and apertures to support a particular product or packaging materials for processing by the packaging device 10. The turntable assembly 30, including the product support plates 194, is configured so that the product support plates 194 can be quickly and easily exchanged to reduce the downtime of the packaging device 10.

The illustrated turntable assembly 30 utilizes the same upper and lower support plates 168, 164 as the second magazine holder 24. In this regard, the product support plates 194 are installed and removed in the same manner as the second magazine 26. Specifically, a first edge 196 of the product support plate 194 is inserted under the lip 182 of the upper support plate 168 and the product support plate 194 is urged toward the center of the bases 190 against the biasing force of the springs 186. The product support plate 194 is then rotated downwardly for engagement with the base while clearing the lip 172 of the lower support plate 164. The biasing force of the springs 186 then urges the product support plate 194 outwardly so that the product support plate 194 is captured by the lip 172 of the lower support plate 164 and engages the positioning pin 166.

What is claimed is:

1. A quick-change tooling system for a device, the device including a moveable support shaft and a vacuum source, the tooling system comprising:

first and second side supports coupled to the support shaft for movement therewith;

a manifold coupled to the support shaft for movement therewith and for communicating with the vacuum source;

a clamp moveable relative to the manifold between a disengaged position and an engaged position; and a plurality of pickers, each picker being selectively engageable with the side supports, the manifold, and the clamp assembly for movement with the support shaft and communication with the vacuum source, each picker including an arrangement of picking members for picking and placing a corresponding item, wherein the picking members communicate with the vacuum source via the manifold, wherein the manifold is a first manifold and each picker includes a second manifold, and wherein the second manifold is sealingly coupled to the first manifold by moving the clamp from the disengaged position to the engaged position.

2. The quick-change tooling system of claim 1, wherein the clamp is coupled to the first manifold and is pivotable between the disengaged position and the engaged position, wherein the clamp biases the second manifold into sealing engagement with the first manifold when the clamp is in the engaged position.

3. The quick-change tooling system of claim 2, wherein the clamp pivots about an axis and includes a roller that is biased toward the axis, wherein the second manifold includes a detent, and wherein when the clamp is moved to the engaged position, the roller engages the detent.

4. A quick-change tooling system for a device, the device including a moveable support shaft and a vacuum source, the tooling system comprising:

first and second side supports coupled to the support shaft for movement therewith;

a manifold coupled to the support shaft for movement therewith and for communicating with the vacuum source;

a clamp moveable relative to the manifold between a disengaged position and an engaged position; and a plurality of pickers, each picker being selectively engageable with the side supports, the manifold, and the clamp assembly for movement with the support shaft and communication with the vacuum source, each picker including an arrangement of picking members for picking and placing a corresponding item, wherein the picking members communicate with the vacuum source via the manifold, wherein each picker includes a mounting plate, and wherein the mounting plate is slidingly received between the first and second side supports, and wherein the manifold is a first manifold and each picker includes a second manifold coupled to the mounting plate, wherein the pickers include substantially identical second manifolds and unique arrangements of picking members.

5. A quick-change tooling system for a device, the device including a moveable support shaft and a vacuum source, the tooling system comprising:

first and second side supports coupled to the support shaft for movement therewith;

a manifold coupled to the support shaft for movement therewith and for communicating with the vacuum source;

a clamp moveable relative to the manifold between a disengaged position and an engaged position; and a plurality of pickers, each picker being selectively engageable with the side supports, the manifold, and the clamp assembly for movement with the support shaft and communication with the vacuum source, each picker including an arrangement of picking members for picking and placing a corresponding item, wherein the picking members communicate with the vacuum source via the manifold, wherein the device includes a heater carriage, the quick-change tooling system further comprising:

first and second side guides coupled to the heater carriage, the side guides each including a locking pin;

a lower stop coupled to the heater carriage between the side guides;

a plurality of interchangeable heater plates, each heater plate selectively engageable with the side guides and removably secured thereto by the locking pins, each heater plate including at least one heater block coupled to a first side of the heater plate, and an upper stop coupled to a second, opposite side of the heater plate.

6. A quick-change picker assembly for a pick and place device, the assembly comprising:

a first manifold communicating with a vacuum source and defining an opening;

a pair of side supports coupled to the manifold;

a mounting plate received between and supported by the side supports;

a second manifold coupled to the mounting plate and defining a chamber, the second manifold engaging the first manifold to afford communication between the chamber and the vacuum source via the first manifold, engagement between the second manifold and the first manifold limiting movement of the mounting plate relative to the side supports in a first direction; and a clamp moveable relative to the manifold between a disengaged position and an engaged position, the clamp limiting movement of the mounting plate relative to the side supports in a second direction opposite the first direction when the clamp is in the engaged position.

7. The quick-change picker assembly of claim 6, wherein the clamp is pivotably coupled to the first manifold and is pivotable between the disengaged position and the engaged position.

8. The quick-change picker assembly of claim 7, wherein the clamp pivots about an axis and includes a roller that is biased toward the axis, wherein the second manifold includes a detent, and wherein when the clamp is moved to the engaged position, the roller engages the detent.

9. The quick-change picker assembly of claim 6, wherein each side support defines a groove, and wherein the grooves open toward one another, the picker assembly further comprising a pair of guides, each guide received by one of the grooves and engaging edges of the mounting plate.

10. The quick-change picker assembly of claim 6, wherein the second manifold is coupled to a first side of the mounting plate, the picker assembly further comprising at least one picking member coupled to a second, opposite side of the mounting plate, the picking member defining a passageway, and the mounting plate defining an aperture communicating with the passageway.

11. The quick-change picker assembly of claim 10, wherein the second manifold defines an opening communicating with the chamber, the picker assembly further comprising a conduit extending between the aperture in the mounting plate and the opening in the second manifold to afford communication between the second manifold chamber and the picking member passageway.

12. A method for changing a configuration of a packaging machine having a vacuum source, the packaging machine including a carriage portion that is moveable between a picking location adjacent a magazine holder, and a placing location adjacent a product support holder, the carriage portion including side supports, the method comprising:

removing from the carriage portion a first picker configured to pick and place a first item, including moving a clamp assembly to a disengaged position, thereby disengaging the first picker from the vacuum source, and extracting the first picker from between the side supports;

installing onto the carriage portion a second picker configured to pick and place a second item, including inserting the second picker between the side supports and moving the clamp assembly to an engaged position to thereby engage the second picker with the vacuum source;

removing from the magazine holder a first magazine configured to support a stack of the first item;

installing onto the magazine holder a second magazine configured to support a stack of the second item, whereby the second picker is operable to remove individual ones of the second item from the second magazine holder;

removing from the product support holder a first product support plate configured to support the first item; and installing onto the product support holder a second product support plate configured to support the second item, whereby the second picker is operable to place the individual ones of the second item onto the second product support plate.

13. The method of claim 12, wherein moving the clamp assembly to the engaged position includes pivoting the clamp assembly to detently engage a manifold of the second picker.

14. The method of claim 12, wherein inserting the second picker between the side supports includes sliding edges of the second picker into slots defined by the side supports.

15. The method of claim 12, wherein installing the second magazine includes inserting an upper edge of the second magazine into a slot defined by the magazine holder, overcoming a biasing force that resists insertion of the upper edge into the slot, pivoting the second magazine toward a support plate spaced from the slot, and allowing the biasing force to urge the second magazine into engagement with a lip of the support plate.

16. The method of claim 12, wherein moving the clamp assembly to the engaged position includes fluidly connecting a manifold of the second picker to the vacuum source for communication therewith, and limiting movement of the mounting plate in at least one direction.

* * * * *